US011097198B2

(12) United States Patent
Kaye

(10) Patent No.: US 11,097,198 B2
(45) **Date of Patent: *Aug. 24, 2021**

(54) POP MECHANISM AND DEVICE FOR REVEALING A WINNER

(71) Applicant: Perry Teri Toys, LLC, Davie, FL (US)

(72) Inventor: Perry Kaye, Cooper City, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/942,754

(22) Filed: Jul. 29, 2020

(65) Prior Publication Data

US 2020/0353374 A1 Nov. 12, 2020

Related U.S. Application Data

(63) Continuation-in-part of application No. 15/430,482, filed on Feb. 11, 2017, now Pat. No. 10,758,835.

(51) Int. Cl.
*A63H 33/00* (2006.01)
*A63H 27/10* (2006.01)

(52) U.S. Cl.
CPC ..... *A63H 33/009* (2013.01); *A63H 27/10* (2013.01)

(58) Field of Classification Search
CPC ..... A63H 33/009; A63H 27/10; A63F 9/0079; A63F 2009/0083; A63F 2009/0084; A63F 2009/0086
See application file for complete search history.

(56) References Cited

U.S. PATENT DOCUMENTS 3,460,830 A * 8/1969 Barlow ..... A63F 9/0079 273/440
3,795,400 A * 3/1974 Glass ..... A63F 9/0079 273/458
3,848,357 A * 11/1974 Morrison ..... A63H 13/06 273/440.1
4,080,751 A * 3/1978 Copstead ..... A63H 33/30 446/220
4,826,161 A * 5/1989 Rookmaaker ..... A63F 9/0079 273/450
4,900,020 A * 2/1990 Rehkemper ..... A63F 9/0079 273/458
5,256,099 A * 10/1993 Rudell ..... A63H 33/009 401/148
5,354,057 A * 10/1994 Pruitt ..... A63B 69/02 273/454
5,984,788 A * 11/1999 Lebensfeld ..... A63F 9/0291 463/51
6,402,582 B1 * 6/2002 Sherer ..... A63H 27/10 273/138.1
6,945,842 B1 * 9/2005 Gulmesoff ..... A63H 5/00 446/401
D638,502 S * 5/2011 Paul ..... D21/568

(Continued)

*Primary Examiner* — Eugene L Kim
*Assistant Examiner* — Alyssa M Hylinski
(74) *Attorney, Agent, or Firm* — Diana Mederos; Mederos Legal, PLLC

(57) ABSTRACT

A pop sensor and device for revealing a winner for use in battle or sword-type games, A device for revealing a winner comprises a bladder, a pop mechanism, a pop mechanism support structure, and a bladder destruction apparatus. The device for revealing a winner is coupled to a pop sensor system comprising a pop sensor. Activating the pop sensor causes the player's pop mechanism to activate and cause the bladder to destroy, instantly disengaging the losing player while revealing the winning player.

12 Claims, 22 Drawing Sheets

(56) References Cited

U.S. PATENT DOCUMENTS

| | | | | |
|---|---|---|---|---|
| 8,257,134 | B2 * | 9/2012 | Zuloff | A63F 5/04 446/220 |
| 9,254,444 | B1 * | 2/2016 | Toomey | A63F 9/0079 |
| 9,757,642 | B2 * | 9/2017 | Kaye | A63H 33/22 |
| 10,758,835 | B1 * | 9/2020 | Kaye | A63H 27/10 |
| 2010/0267309 | A1 * | 10/2010 | Hyland | A63F 9/0079 446/188 |

* cited by examiner

POP MECHANISM AND DEVICE FOR REVEALING A WINNER

CROSS REFERENCE TO RELATED APPLICATIONS

This application is a continuation-in-part of U.S. Non-provisional application Ser. No. 15/430,482 entitled Pop Sensor System and Device for Revealing a Winner, filed on Feb. 11, 2017, which claims the benefit of U.S. Provisional Patent Application Ser. No. 62/295,000, filed on Feb. 12, 2016, the entire contents of which are incorporated herein by this reference.

FIELD OF THE INVENTION

The present invention relates to a device for revealing a winner. The current embodiments are in the field of toys and games and reveal a winner in play battle or sport. Specifically, the device utilizes at least one sensing mechanism for revealing a winner. More specifically, a device for revealing a winner may comprise a filled bladder threaded through a pop mechanism support to result in a type of sword toy. The sword toy is coupled with a sensor that when activated, communicates with a pop mechanism to destroy the filled bladder. In game play with two or more players, the player with the destroyed bladder is the loser, thus revealing the winner, the player who did not have his/her sensor activated.

BACKGROUND

Balloons have been used for many years as objects of play. Children and adults often use balloons as decorations and costumes, and for play battle/sport. The bright colors, low cost, lightweight and squishy nature of balloons make them a suitable toy for children and adults to enjoy. Children use toy balloon swords because they give each child a way to act out battle/sports without a risk of harm from their play weapon during play. Since balloons also have the tendency to light up, they have been used to simulate light sabers. balloons are also known for their ability to create a loud sound when they burst, typically resulting in sound levels of around 125 decibels.

Clowns and entertainers have made balloon swords for decades. A thin balloon's long shaft is twisted into a shape having a long end leading to a simulated cross-guard just above a grip. A pommel is sometimes simulated by adding a twist and knot to the grip's end for the appearance of a real sword's pommel feature. However, these balloon swords often are difficult to maintain a grip and do not have any structural rigidity to support the balloon for more serious and engaging sword fight games. Nevertheless, these toys are common, fun, and have inspired other toy sword inventions including devices that use a balloon attached to a grip to simulate a sword with a light in the handle to make the balloon glow and a pump in the handle can blow up the balloon. This lets players simulate battle/sport but does not offer a clear indication of win. This lack of certainty often causes fights amongst players. We often hear kids, in fantasy battle/sport, say things like, "You didn't win because I hit you first", or "you would have dropped the sword before you hit me because I got your leg." While these tussles are often minor, they do make it difficult to keep score and cause delays during play. Sometimes feelings are hurt and the enjoyment of the battle/sport is lessened. There is no sword game that indicates a clear winner in a fantasy battle/sport.

Other inventions attempt to solve the problem, caused by a lack of clear winner indication, by using a sound generating mechanism to indicate a win. One example in U.S. Pat. No. 7,476,141 entitled Toy Balloon Saber and U.S. Pat. No. 7,033,242 entitled Toy Sword with Contact Indicator show a play sword with an ability to pop an internal balloon when pressure is applied to the sword's tip. An unfortunate problem with this invention is that the winner, the victor of the play battle/sport, is the one whose weapon is damaged to indicate the win. This means that even though the player won the battle/sport, that player loses a feature of his/her own sword. There have been attempts to remedy this problem by audiovisual feedback in the form of a sound and/or light generator. But the sounds and light created by the generators do not disengage the losing player from the sword/battle game. The losing player, despite audiovisual feedback indicating such, is still capable of using the sword.

In prior sword game technologies, game and role play was neither exciting nor clearly indicated the real and actual winner of the game. Play battle/sport equipment without an ability to simultaneously reveal a winner and disengage a loser often leads to arguments. Technology that destroys or damages the winner's equipment to indicate a win is counterintuitive and disheartening to the winner.

Furthermore, in traditional battle and sword fight toy games, player one and player two hit each other's swords. The indication of a win or a loss is indicated by a response from at least one of the player's swords. If one player, with his/her sword, contacts the other player's body, then the sword likely will not be able to disengage or indicate a loss for the "losing" player. The "losing" player will continue to be able to play in the sword fight game, even though the player had been struck on a "lethal" area of the body.

SUMMARY

What is needed is a battle or sword type game that allows for a quick, safe, and clear indication and distinction of a winning player and a losing player. A pop sensor and a device for revealing a winner as described herein is for use in such games for solo play and for games with at least two players.

A device for revealing a winner comprises a bladder, a pop mechanism, a pop mechanism support structure, and a bladder destruction apparatus. The device for revealing a winner is coupled to a pop sensor system comprising a pop sensor that is worn on the player's body. A player may wear one or more pop sensors. Activating the pop sensor causes the player's pop mechanism to activate and cause the bladder to destroy. This disengages the losing player while revealing the winning player.

A device for revealing a winner may comprise decorative attachments that are fastened to a pop mechanism support structure. The pop mechanism support structure comprises an interior wall, an exterior wall, a cavity, and a pop mechanism. The pop mechanism further comprises a bladder destruction apparatus.

A pop sensor system comprises a pop sensor. The pop sensor may be in communication with a logic circuit which may be in further communication with a logic circuit contained in a pop mechanism. Communication between logic circuits initiates the bladder destruction device. The bladder destruction device contacts the bladder to cause its destruction.

The player with the destroyed bladder is disengaged, and the other player who activated the pop sensor is revealed as the winning player.

Definitions

"Bladder" as used herein means any inflatable hollow structure and is used interchangeably with balloon. A bladder may be made from foam, plastic, elastic, rubber, nylon, or latex.

"Fastener" as used herein means an apparatus such as a screw, nail, bolt, rivet, anchor, button, hook and eye, adhesive, tape, hook and pile tape, snap, clasp, clasp locker (like zipper), and/or glue.

As used herein, the term "and/or," when used in a list of two or more items, means that any one of the listed items can be employed by itself, or any combination of two or more of the listed items can be employed. For example, if a device is described as containing components A, B, and/or C, the composition can contain A alone; B alone; C alone; A and B in combination; A and C in combination; B and C in combination; or A, B, and C in combination.

"Logic circuit" as used herein means an electric circuit or mechanism with an ability to determine an outcome, such as a logic circuit, micro control unit (MCU), microprocessor/embedded-controller with software stored in any computer readable storage media.

"Wireless communication" as used herein means any communication network or data transfer system for transmitting computer-readable data via infrared, magnets, Wi-Fi, Bluetooth, radio, near-field connection, satellite, WiMAX, ZigBee, or microwave.

"Destroy" as used herein means burn, tear, rip, deflate, pop, melt, disintegrate, or deform.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Figure 1:
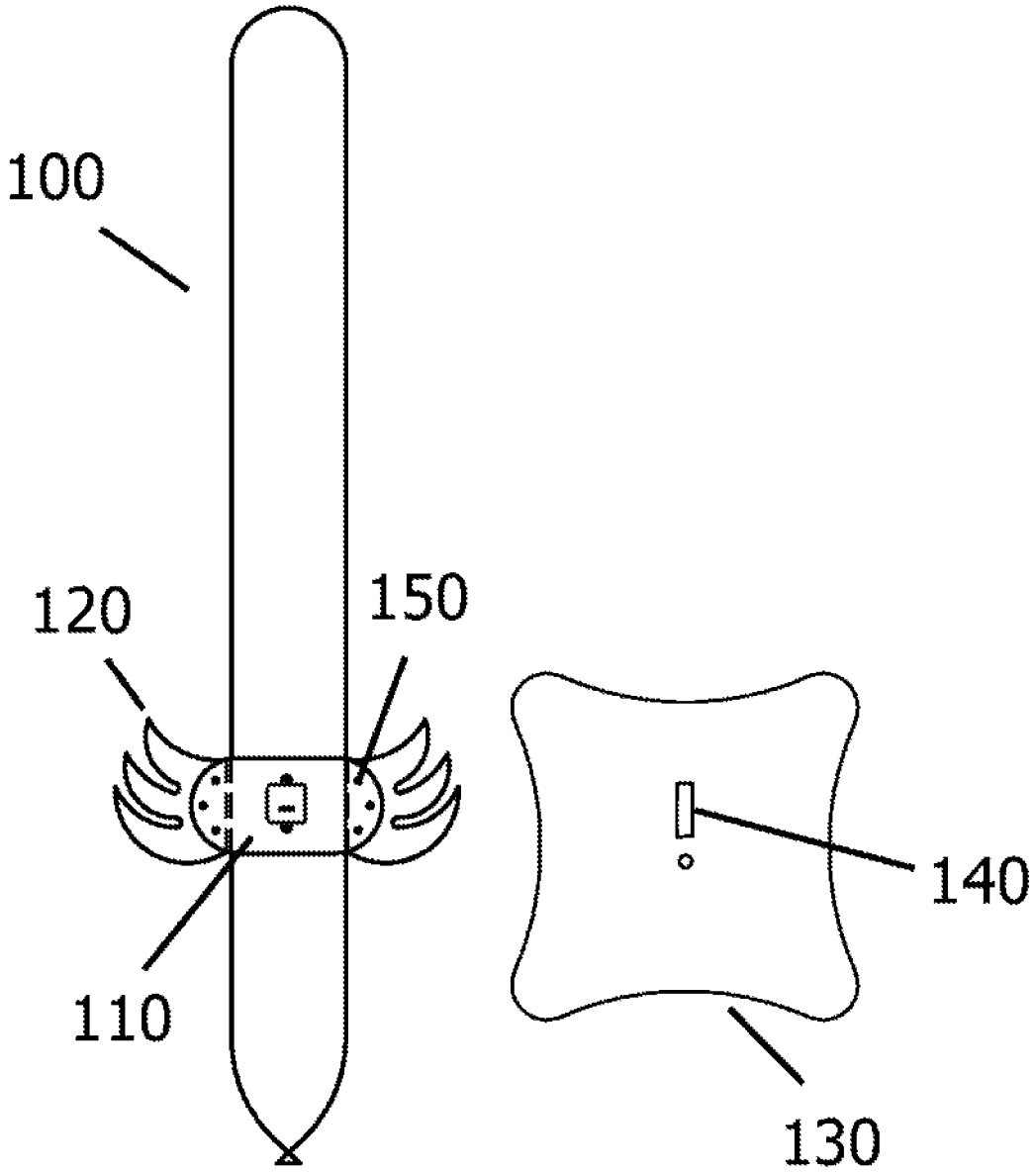
FIG. 1 shows a front view of a wireless version of a device with a bladder 100 with a pop sensor system 130 containing a pop sensor 140, and a pop mechanism support structure 110 with replaceable decorative attachments 120 and fasteners 150.

Detailed descriptions of particular embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

A system for a device for revealing a winner may comprise a bladder, a pop sensor system, a pop sensor, a pop mechanism support structure, a pop mechanism, a bladder destruction apparatus, and a logic circuit. A player fills a bladder that is then inserted through a cavity of the pop mechanism support structure. The pop mechanism support structure has an outer surface whereby a pop sensor system is attached and an inner surface about the cavity whereby the pop mechanism with the bladder destruction apparatus is attached. The bladder and the pop mechanism and inner surface of the pop mechanism support structure should sufficiently secure the bladder. The bladder should frictionally fit so that the pop mechanism support structure substantially remains in place and does not slide substantially down or off the bladder.

A player uses the system and device for revealing a winner by inflating or filling a bladder and slidably attaching the pop mechanism support structure to the bladder. A bladder may be a balloon that is pumped with a gas such as air. Preferred embodiments include an elongated balloon that may be inflated with 5 to 10 pumps of air from a standard, handheld balloon pump. The rigidity of the bladder may be adjusted to a player's preference by filling it to the desired level. However, the circumference of the bladder should be less than an inside circumference or diameter of the pop mechanism support structure cavity. The bladder should frictionally fit against an interior surface of the pop mechanism support structure, and more specifically frictionally fit against the pop mechanism.

A player may obtain a separate pop sensor that may be wirelessly in communication with a logic circuit and pop mechanism of a pop mechanism support structure, or logic circuits of the pop sensor and of the pop mechanism may be connected by at least one wire. The pop sensor may be worn by the player by being fastened to a harness, vest, clothing, or accessory. More than one pop sensor may be worn by a player, and more than one pop mechanism support structure and bladder may be combined to form a single toy sword. The pop mechanism and the pop sensor may be powered by a power source such as at least one battery and may be initiated by a switch, a remote control, a button, a toggle, or a sensor.

At least two players may engage in role playing combat or other sword or battle type games. The goal of each player is to apply touch or pressure to the other player's pop sensor worn on the other player's person. This simulates striking, piercing, stabbing, or slashing the opponent player to "kill" the opponent to disengage him/her, making him/her the losing player and the striking player the winning player. When the losing player's pop sensor is struck by the winning player's bladder device, body part, or any other type of device, the pop sensor transmits data to a logic circuit which transmits, either via wireless communication or via a wire to a receiver in the losing player's pop sensor's logic circuit which activates, either mechanically or electronically, a bladder destruction apparatus. The bladder destruction apparatus engages and effectively pops or destroys the losing player's sword bladder. The losing player is no longer able to play the battle game because the losing player substantially instantaneously and involuntarily no longer has a weapon.

Turning to FIG. 1, a wireless version of a device with a bladder 100 with a pop sensor system 130 containing a pop sensor 140, and a pop mechanism support structure 110 with replaceable decorative attachments 120 and fasteners 150 is illustrated. A balloon or other inflatable or hollow apparatus or bladder may be used in the methods and systems described and may be fully, substantially, partly, or in combination filled with a solid, liquid, and/or gas. A pop mechanism support structure is fitted and secured about a circumference of the bladder. A pop mechanism support structure may also comprise of a plurality of cavities that accept bladders. The pop mechanism support structure may be like a cuff and may or may be able to be opened and adjusted by opening and closing fasteners. A pop mechanism support structure may be circular or polygonal.

A pop support structure may also have a motorized or other type of spinning or rotating device that may facilitate rotation of a bladder. For example, a pop support structure may facilitate automatic loading and inflating of a bladder in the form of a balloon once the player's balloon is popped, thus adding difficulty and more excitement to a sword-fight type game. Such automatic loading and inflating may be facilitated by cartridges of bladders and cartridges of a filler material such as a sold, liquid, gas, or combination thereof. The cartridges may be connected to a logic circuit in communication with a sensor in further communication with mechanical releases and/or in some embodiments, when the balloon is popped the pop mechanism support structure may fall to the ground, making the losing player out of the game and instantly revealing the winner.

The pop mechanism support structure may also have replaceable decorative attachments that are either permanently or removably attached to the pop mechanism support structure. The decorative attachments are fastened by fasteners to the pop mechanism support structure. The pop mechanism support structure may serve as a cuff to frictionally hold on to the bladder. The pop mechanism support structure may also serve as a handle for the player to comfortably grab the bladder for extended sword fight or game playing time. The pop mechanism support structure itself or as a removable attachment may have an elongated portion for improved grip by a player. The pop mechanism support structure may have an extended cup portion to protect a player's hand and/or to improve grip.

The pop sensor system may have at least one power source (not shown) such as a battery in a battery compartment that powers a logic circuit which monitors at least one sensor such as a tactile or pressure sensor, a pop sensor in a pop sensor system. The pop sensor may be activated by pressure applied to the pop sensor surface by an opposing player's balloon.

A logic circuit may execute software commands to the mechanical device with a pressure sensor based on a spring or magnet set to disengage at a set weight. The software is stored in computer-readable tangible media. In many embodiments, an MCU or embedded controller or central processing unit (CPU) will have software that enables it to read sensors and then perform actions based on the triggering of the sensors. The actions can be to burst the bladder or to notify the other device to burst its bladder. Reading of the sensors, including win or loss indications and messages from other devises informing of wins/losses. Actions can include bursting bladders, sending and decoding messages, playing sounds, keeping score, lighting lights and calculating and notifying players when events start and when they end (battle rounds for example).

The sensitivities of the sensor may be adjusted. Once the logic circuit determines that the pop sensor indicates a winning event, the pop sensor system communicates with opponent's sword, via transmitters (not shown), and the opponent's sword receives the communication through receivers (not shown) that the opponent's sword should burst. Each sword has transmitters (not shown) and receivers (not shown), part of a logic circuit, through which a pop sensor and a pop mechanism can communicate.

The pop sensor system and the pop mechanism support structure may communicate wirelessly by transmitting and receiving wireless signals or other communication signals such as via satellite, Wi-Fi, sound, infrared, laser, radio, Bluetooth, near field communication, magnets, light, or any other wireless form of communication. The wireless communication from the pop sensor system to the pop mechanism support system will facilitate either a pop of the balloon when the pop sensor is activated.

The pop sensor system and the pop mechanism support structure (both or one or the other) may have a logic circuit, manual dials, switches, or controls to adjust the sensitivities and device power. The pop sensor system and/or the pop mechanism support system and/or a pop mechanism may have a central processing unit with software which communicates, reads, executes, and transmits signals to perform various functions such as device power, sensitivities, LED power and color, winner or loser indication, motors, battery display, LCD display or console, fingerprint scanner, temperature and pressure regulator, movement sensors, or any other ancillary component to a pop sensor system or a pop mechanism support structure or a pop mechanism.

In some embodiments, a pop mechanism support structure may also contain a compartment to store extra deflated balloons or bladders. A pop mechanism support structure may also contain a compartment to store CO2 or other pressurized gas containers with tubing for instant air inflation of a balloon. The inside circumference of the pop mechanism support structure may have a coating such a silicone or rubber to prevent the balloon from slipping away and increasing grip. The coating may be smooth or textured or have a three-dimensional surface. The pop mechanism support structure may be positioned along any part of the balloon.

Figure 2:
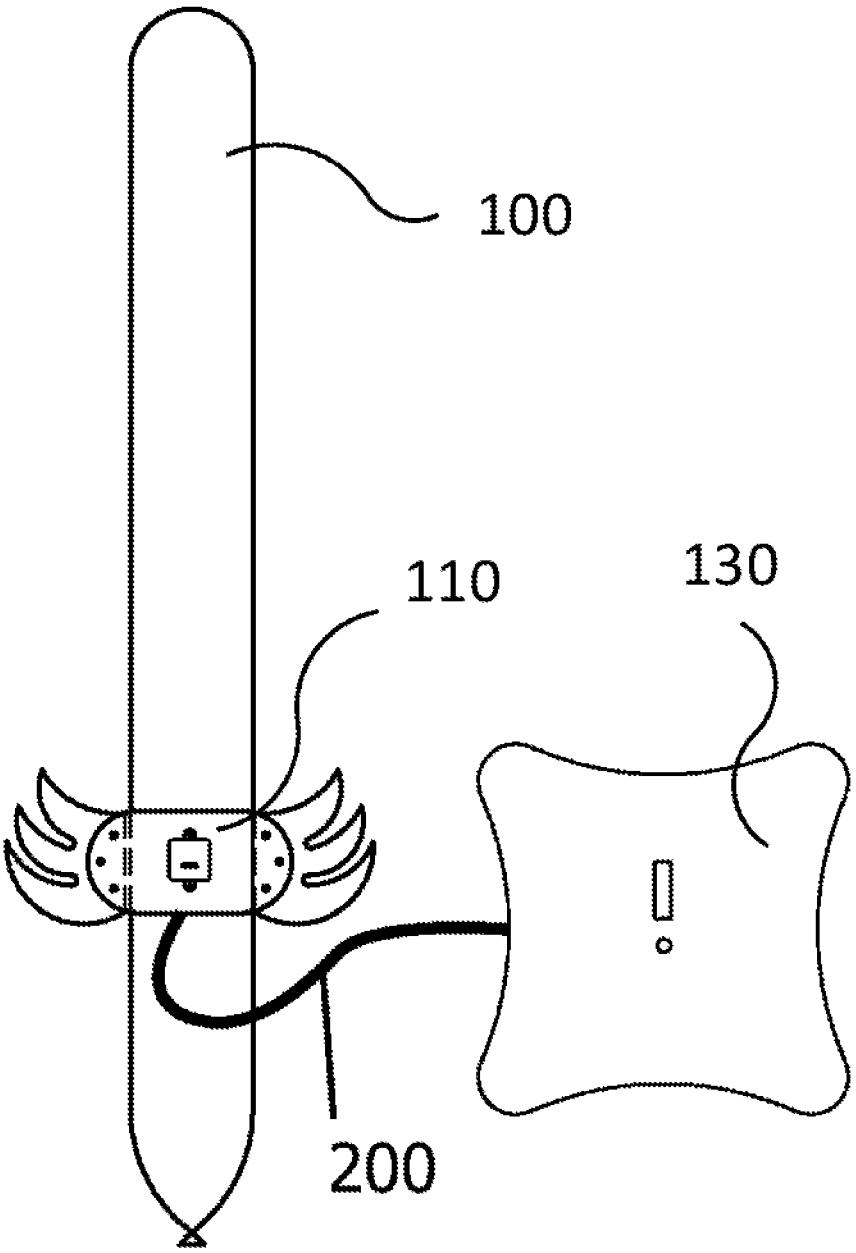
FIG. 2 shows a front view of a wired version of a device with a wire 200 connected to a pop sensor system 130 and to a pop mechanism support structure 110 with a bladder 100.

Turning to FIG. 2, a front view of a wired version of a device with a wire 200 connected to a pop sensor system 130 and to a pop mechanism support structure is illustrated. The wired version of the system described in FIG. 1 may lack wireless communication capabilities or may have still contain wireless communication capabilities but also have the option for wired communication between a pop sensor system and a pop mechanism system. The wired system allows the players to pay the game for a longer time and may provide a backup in case of limited wireless connection availability. A wire may be fixably or removable connected to the pop sensor system and/or the pop mechanism support structure.

Figure 3:
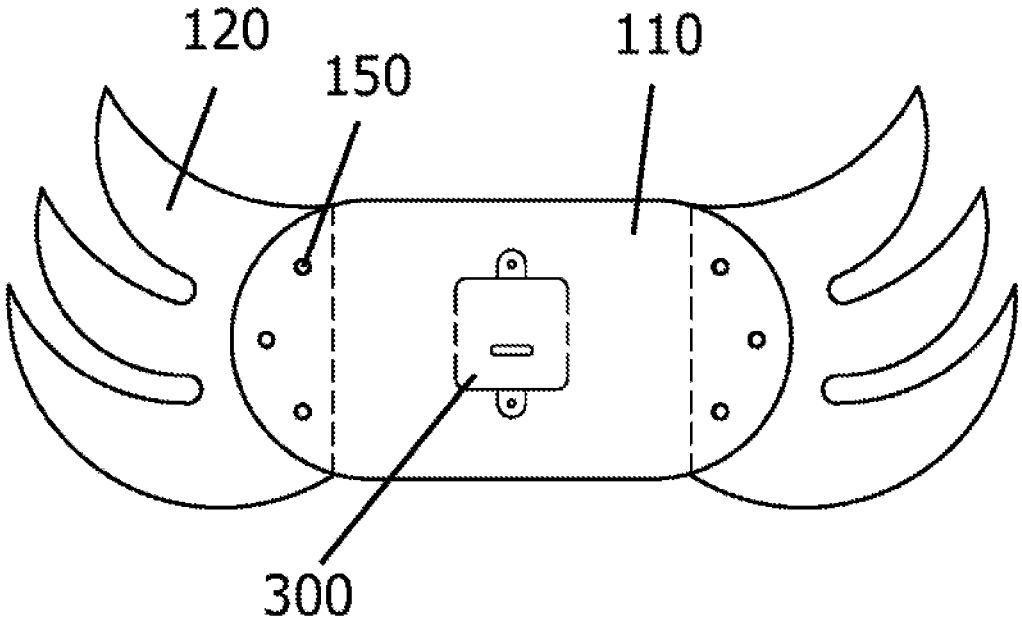
FIG. 3 shows front view of a pop mechanism support structure 110 with decorative attachments 120, fasteners 150, and a pop mechanism 300.

Turning to FIG. 3, a front view of a pop mechanism support structure 110 with decorative attachments 120, fasteners 150, and a pop mechanism 300 is illustrated. FIG. 3 shows the pop mechanism support structure as described in FIG. 1. An exemplary placement of a pop mechanism is shown on the interior of the pop mechanism support structure. The pop mechanism may be fixedly or removably attached to the pop mechanism support structure and may be secured with at least one fastener. The decorative attachments may be fixably or removably attached and may be in virtually any shape or style. The decorative attachments may be flexible or rigid and may be made from natural or synthetic materials.

Figure 4:
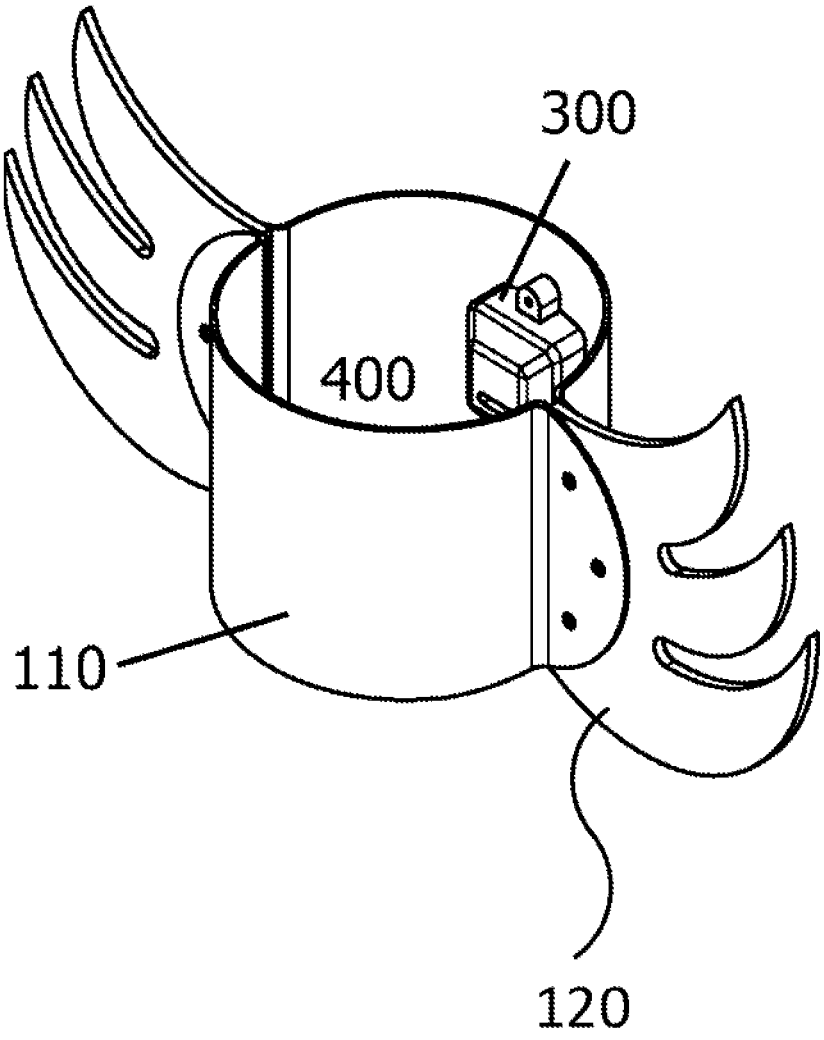
FIG. 4 shows a perspective view of a pop mechanism support structure with decorative attachments 120, a cavity 400, and a pop mechanism 300 with a pop mechanism support structure 110.

Turning to FIG. 4, a perspective view of a pop mechanism support structure 110 with decorative attachments 120, a cavity 400, and a pop mechanism 300 is illustrated. The pop mechanism is shown along the interior of the pop mechanism support structure. In preferred embodiments, the pop mechanism houses a puncture or abrasive apparatus (also referred to as a bladder destruction apparatus) such as a blade or a needle or a serrated surface that may be retractable. In some embodiments, the pop mechanism may have a bladder destruction apparatus such as a motorized wheel of sandpaper that contact and destroy the bladder's surface. The bladder destruction apparatus may also function by a spring coil, pneumatically, or be induced by pressure. The pop mechanism is positioned so that when the pop mechanism is activated, the puncture or abrasive apparatus protrudes through the pop mechanism housing or other type of cavity, toward the cavity to accept the balloon, and into or touching the balloon.

Figure 5:
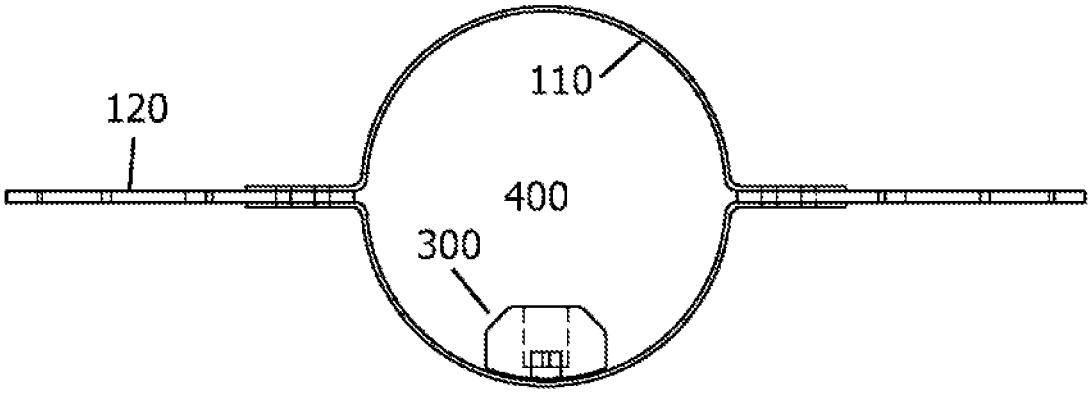
FIG. 5 shows a top view of a pop mechanism support structure 110 with a cavity 400, pop mechanism 300 and decorative attachments 120.

Turning to FIG. 5, a top view of a pop mechanism support structure 110 with a cavity 400, pop mechanism 300 and decorative attachments 120. The pop mechanism is shown protruding in the cavity to accept a bladder.

Figure 6:
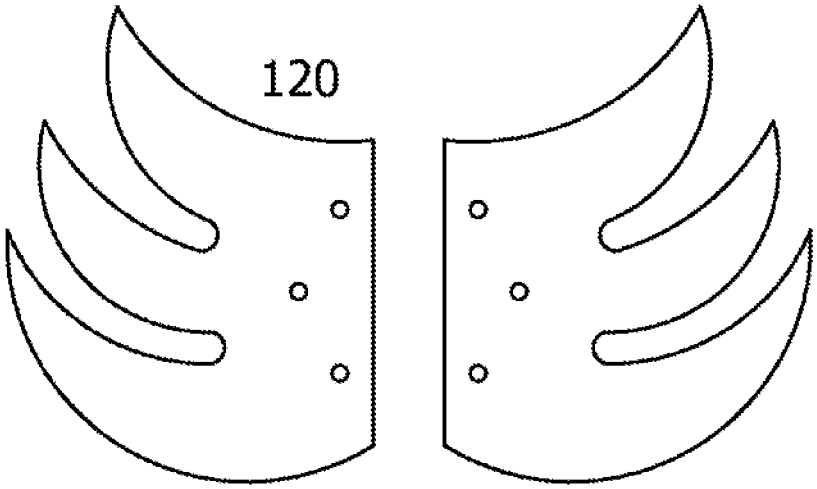
FIG. 6 shows a front view of unmounted decorative attachments 120.
Figure 7:
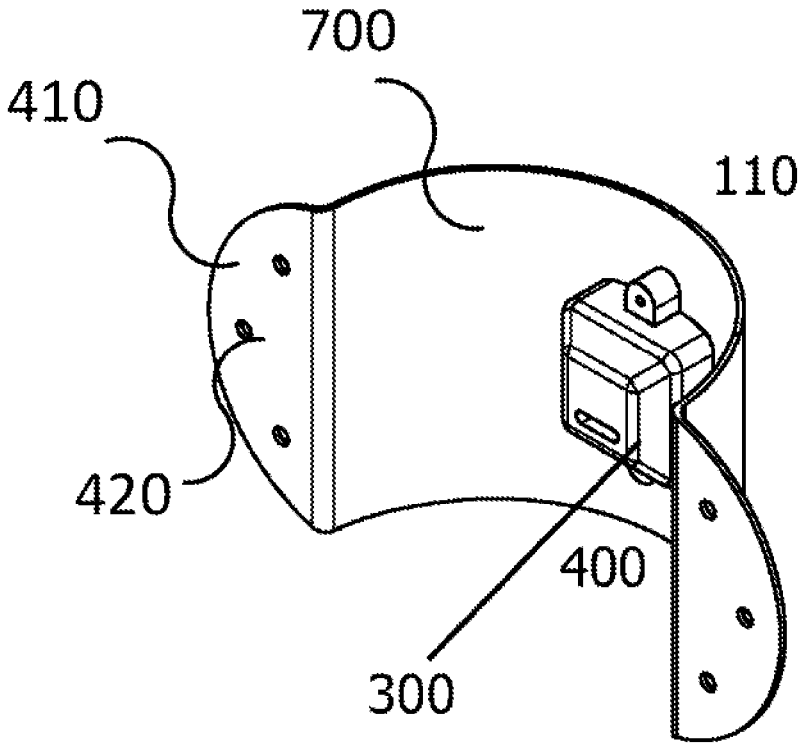
FIG. 7 shows a cross section view of a pop mechanism support structure 110 with a pop mechanism 300 attached to an interior surface 700, a cavity 400, and tabs 410 with fastener receivers 420.
Figure 8:
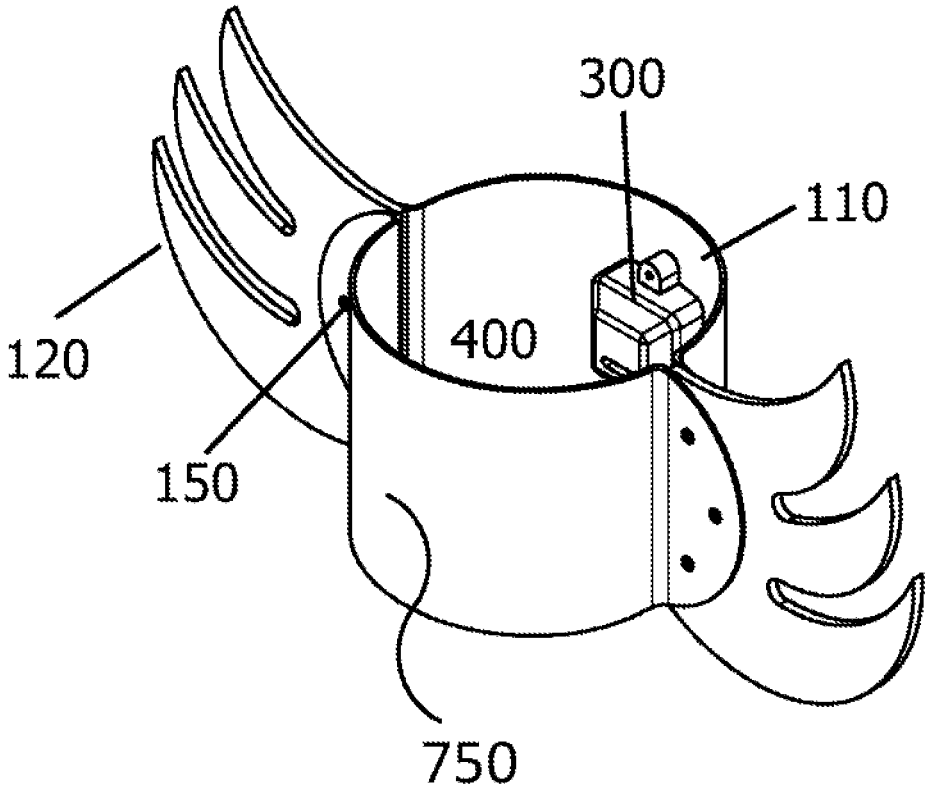
FIG. 8 shows a perspective view of a pop mechanism support structure 110 with a cavity 400, an exterior surface, a pop mechanism 300, decorative attachments 120, and fasteners 150.

Turning to FIGS. 6-8, various views of decorative attachments and pop mechanism support structures are illustrated. FIG. 6 shows a front view of unmounted decorative attachments 120. FIG. 7 shows a cross section view of a pop mechanism support structure 110 with a pop mechanism 300 attached, an interior wall 700, a cavity 400, and tabs 410 with fastener receivers 420. FIG. 8 shows a perspective view of a pop mechanism support structure 110 with a cavity 400, an exterior wall, a pop mechanism 300, decorative attachments 120, and fasteners 150. The tabs may be lateral extensions of the pop mechanism support structure and may have at least one fastener receiver to aid in supporting and securing any attachments, decorative or otherwise.

The invention described herein may include a kit or various kits or add-ons having many decorative attachments. There may be at least one decorative attachment with a fastener that corresponds with a coordinating attachment fastener on a pop mechanism support structure. For example, the decorative attachments may have a series of hole through which fasteners such as screws are inserted that coordinate with the same series of holes on a pop mechanism support structure to receive a coordinating fastener. The pop mechanism support structures and decorative attachments may be interchangeable. Adhesive fasteners may be used such as a double-sided adhesive that may be one-time use or reusable.

Figure 9:
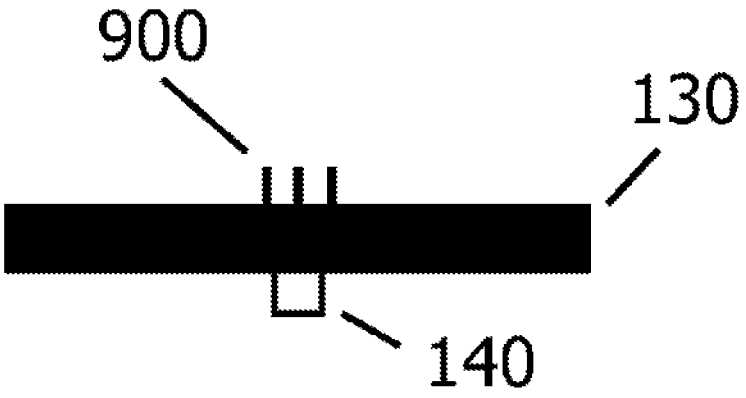
FIG. 9 shows a top view of a pop sensor system 130 with pop sensor 140 and pop sensor fastener 900.
Figure 10:
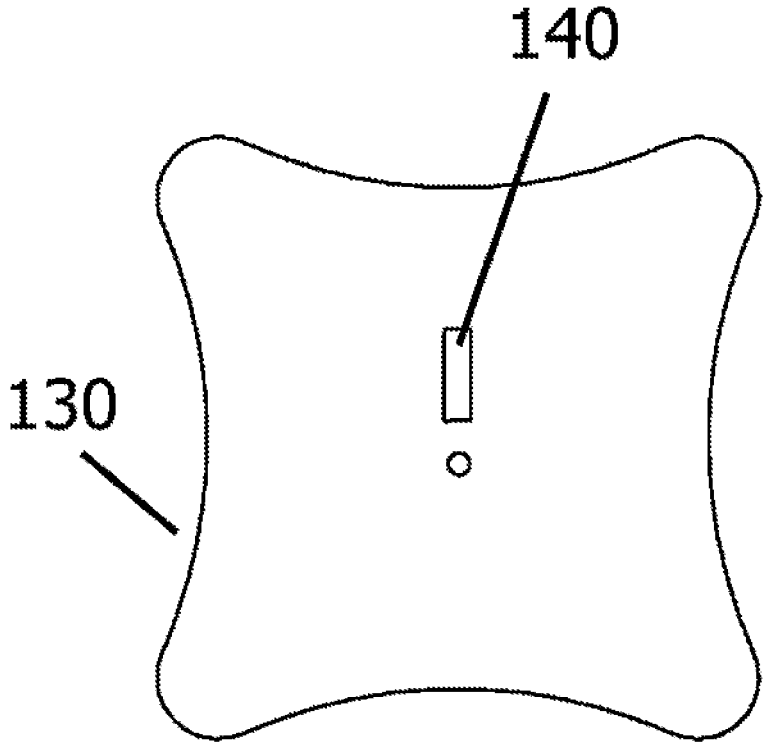
FIG. 10 shows a front view of a pop sensor system 130 with a pop sensor 140.
Figure 11:
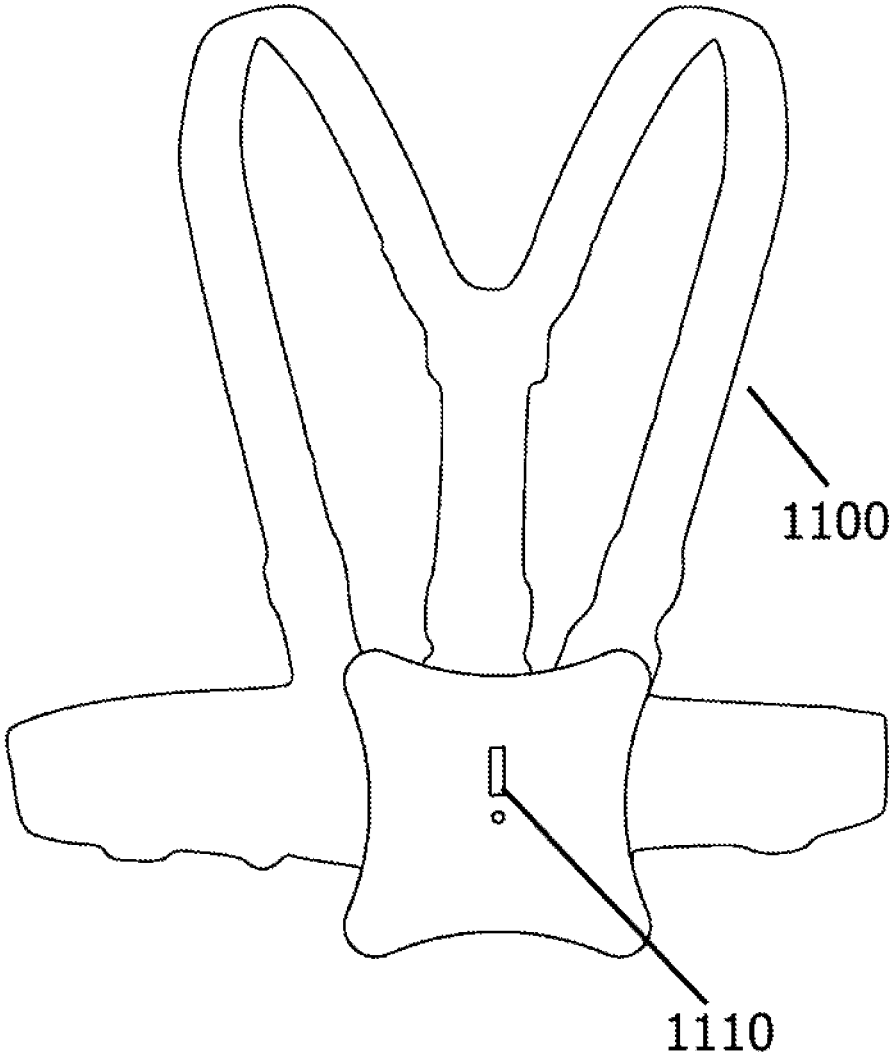
FIG. 11 shows a front view of a pop sensor system harness 1100 with an auxiliary fastener 1110.

Turning to FIGS. 9-11, various views of a pop sensor system with a pop sensor and fastener are illustrated. Specifically, FIG. 9 shows a top view of a pop sensor system 130 with pop sensor 140 and pop sensor fastener 900. FIG. 10 shows a front view of a pop sensor system 130 with a pop sensor 140. FIG. 11 shows a front view of a pop sensor system harness 1100 with an auxiliary fastener 1110.

The pop sensor system may be interchangeable and may be attached to a variety of surfaces. In some embodiments, a pop sensor may be present on the opposite side of the pop sensor system for the side of a fastener. The fastener, in some embodiments, is positioned toward the player's body while the player is wearing the pop sensor system. An opponent presses against the pop sensor. The fastener may be a fabric or mechanical fastener. For example, a fastener on the pop sensor system may coordinate to a fastener on a shirt or other removable wearable such as a harness, vest, or piece of jewelry. Velcro, which is a type of hook and pile tape, is an example of a fastener having coordinating surfaces that will stick together.

Figure 12:
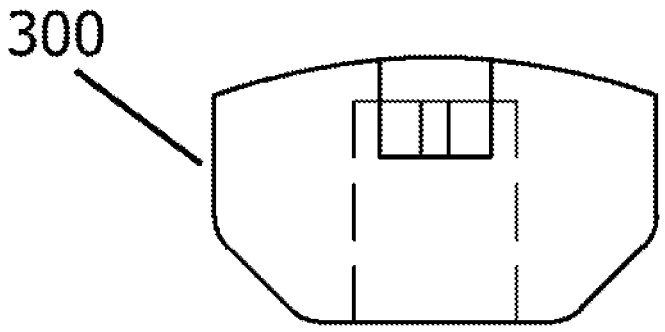
FIG. 12 shows a top view of a pop mechanism 300 with a bladder destruction apparatus 1300 in a non-popping position (not visible).
Figure 13:
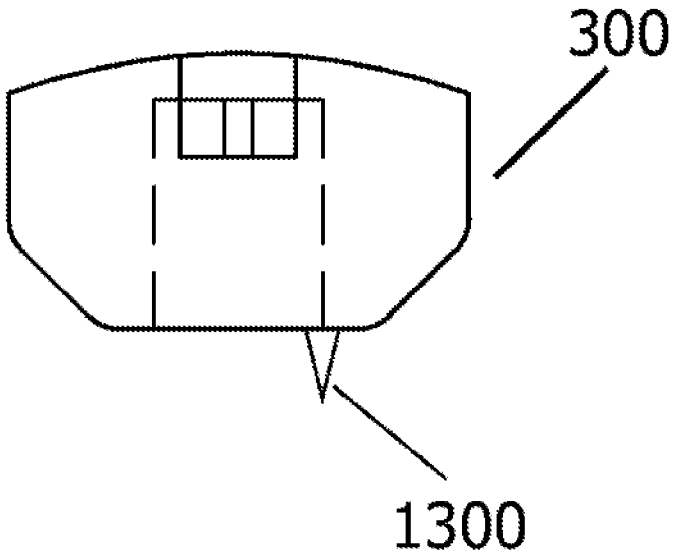
FIG. 13 shows a top view of a pop mechanism 300 with a bladder destruction apparatus 1300 in a popping position.
Figure 14:
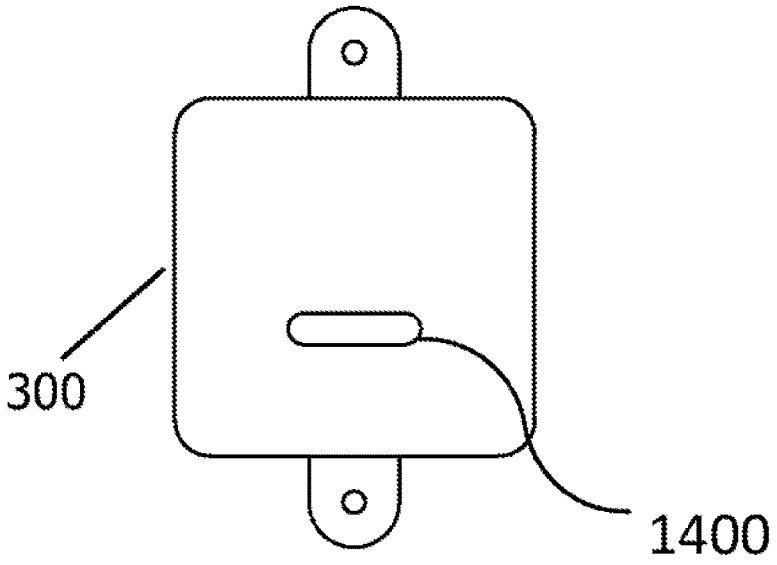
FIG. 14 shows a front view of a pop mechanism 300 with a bladder destruction apparatus 1300 in a non-popping position (not visible) and an aperture 1400.
Figure 15:
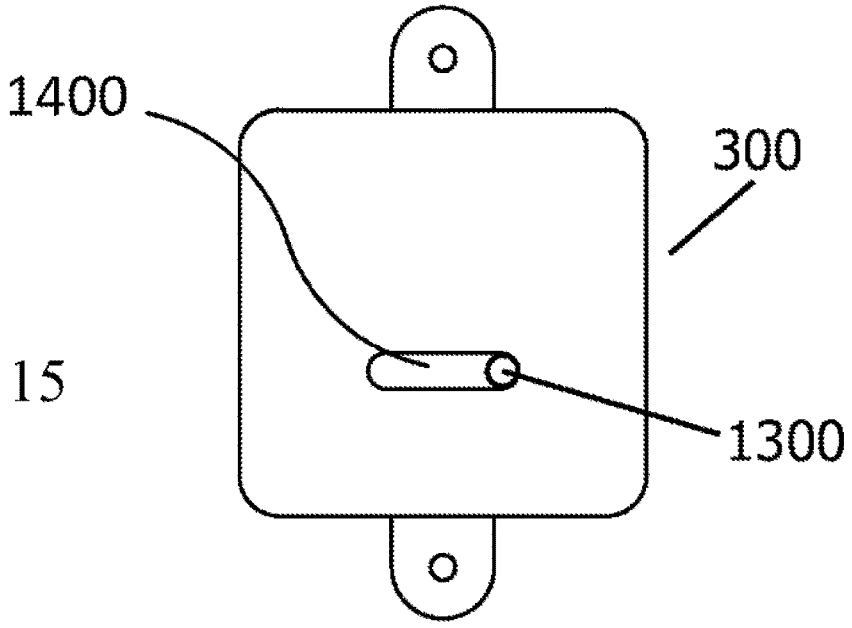
FIG. 15 shows a top view of a pop mechanism 300 with a bladder destruction apparatus 1300 in a popping position and an aperture 1400.

Turning to FIGS. 12-15, various views of a pop mechanism with a bladder destruction apparatus are illustrated. FIGS. 12 and 14 shows the pop mechanism 300 with the bladder destruction apparatus 1300 in a non-popping position. That is, the popping apparatus (bladder destruction apparatus 1300) such as a needle or a blade is retracted within the popping mechanism 300 aperture 1400. FIG. 12 shows a top view of a pop mechanism 300 with a bladder destruction apparatus 1300 in a non-popping position. FIG. 13 shows a top view of a pop mechanism with a bladder destruction apparatus 1300 in a popping position. FIG. 14 shows a front view of a pop mechanism with a bladder destruction apparatus 1300 in a non-popping position. In FIGS. 13 and 15, the bladder destruction apparatus is shown as a blade in a popping position. FIG. 15 shows a top view of a pop mechanism 300 with a bladder destruction apparatus 1300 in a popping position, the bladder destruction apparatus 1300 protruding from the aperture 1400 on the pop mechanism 300 and toward the cavity 400 of the pop mechanism support structure. That is, a blade is protruding into the cavity that accepts at least one bladder.

The bladder destruction apparatus may be motorized, spring-loaded, magnetic, or have other mechanical or digital apparatuses for protrusion and retraction. The bladder destruction apparatus may pop a bladder by puncture, tear, rub, slice, heat, chemical, or laser, for example. Examples of chemicals are corrosive bases with a pH between 8 and 14, inclusive or acids with a pH between 1 and 6, inclusive. Heat may be from a heat source such as an electrical coil. The bladder destruction apparatus may be connected to the logic circuit. The logic circuit may process data and commands wirelessly communicated from a pop sensor to initiate the pop mechanism.

Figure 16:
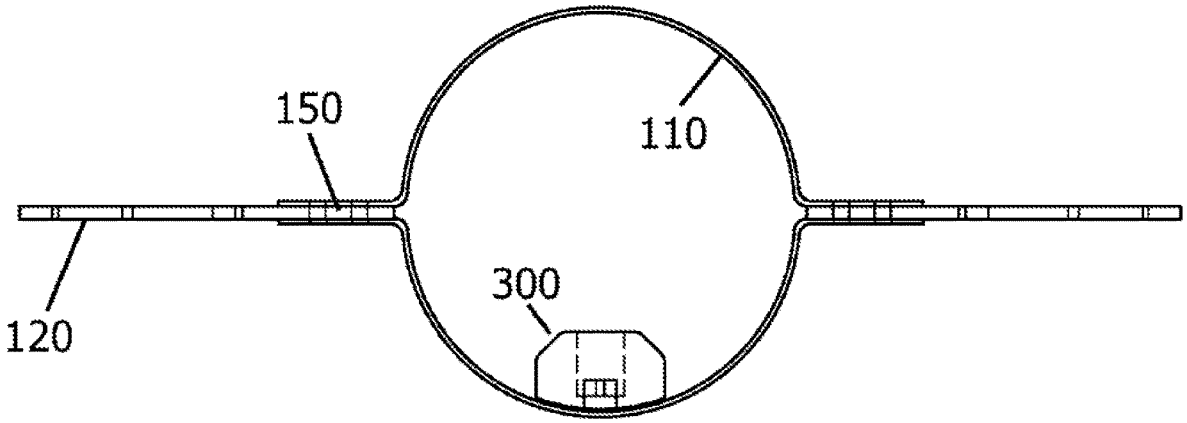
FIG. 16 shows a top view of a pop mechanism support structure 110 with decorative attachments 120, fasteners 150, and a pop mechanism 300 with bladder destruction apparatus 1300 in a non-popping position (not visible).
Figure 17:
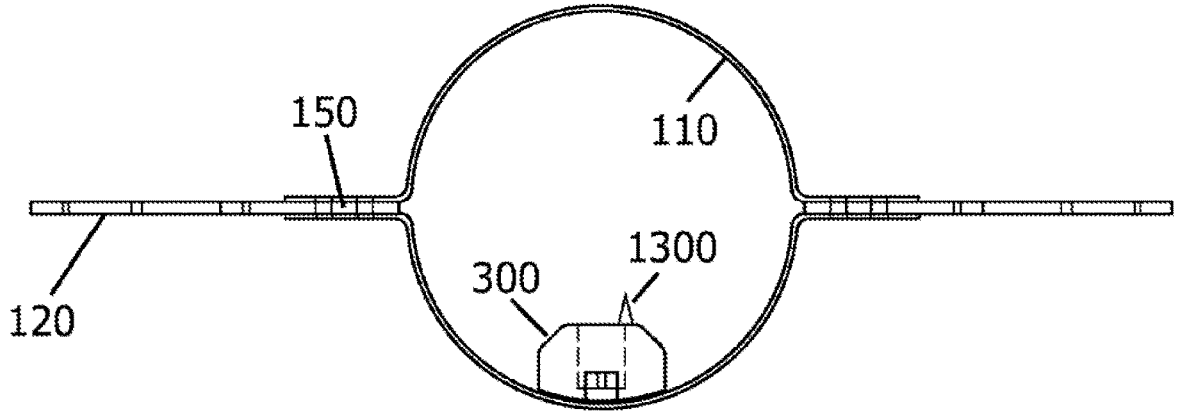
FIG. 17 shows a top view of a pop mechanism support structure 110 with decorative attachments 120, fasteners 150, and pop mechanism 300 with a bladder destruction apparatus 1300 in a popping position.

Turning to FIGS. 16 and 17, a top view of a pop mechanism support structure 110 in a non-popping position and a popping position are illustrated, respectively. Specifically, FIG. 16 shows a top view of a pop mechanism support structure 110 with decorative attachments 120, fasteners 150, and a pop mechanism 300 with bladder destruction apparatus 1300 in a non-popping position, thus not visible. FIG. 17 shows a top view of a pop mechanism support structure 110 with decorative attachments 120, fasteners 150, and pop mechanism 300 with a bladder destruction apparatus 1300 in a popping position, thus visible.

The protrusion length of the bladder destruction apparatus may be adjusted manually, digitally, or automatically. The bladder destruction apparatus may automatically retract after it protrudes to pop the balloon, thereby increasing the safety of the device. The bladder destruction apparatus may have a type of protective coating or dullness to prevent accidental injuries.

Figure 18:
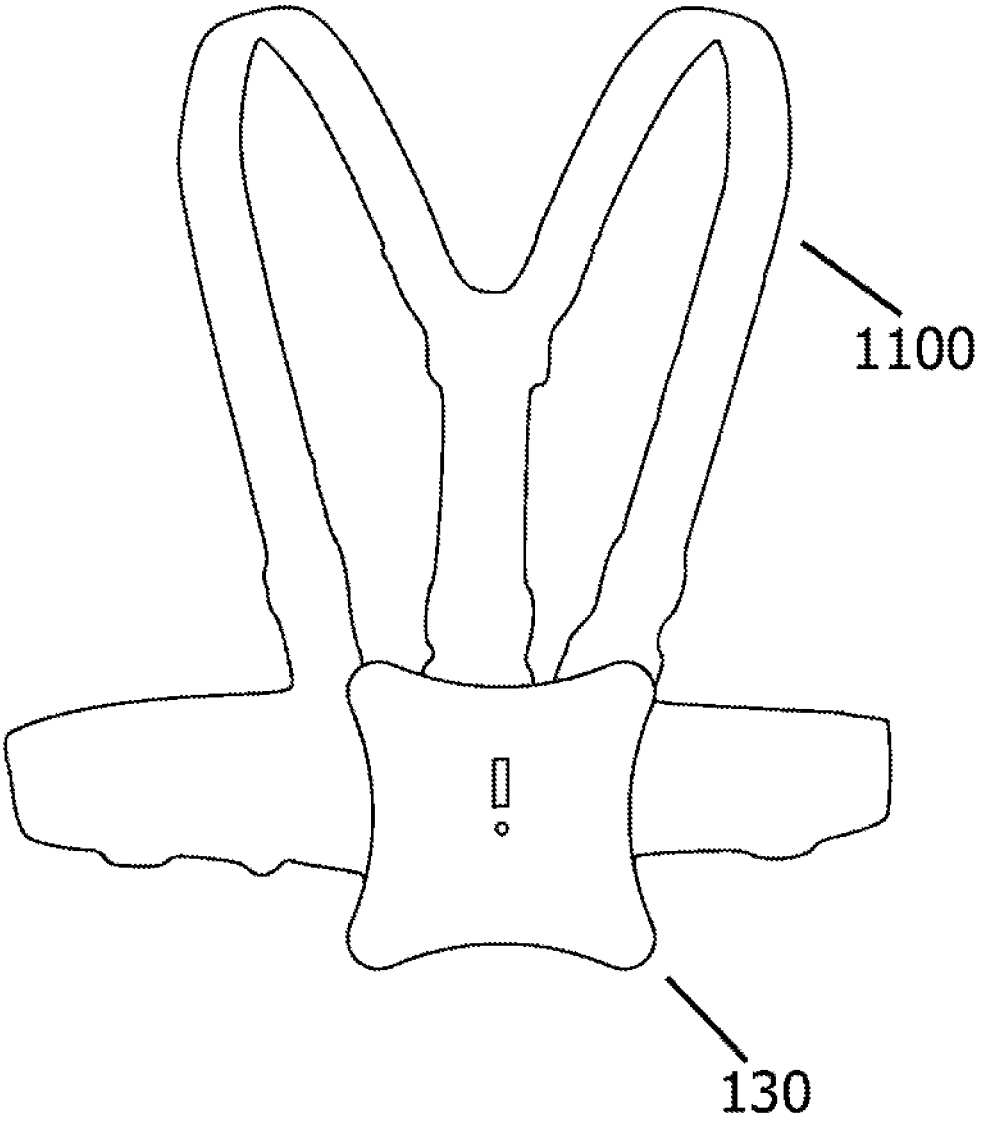
FIG. 18 shows a front view of a harness 1100 with a pop sensor system 130 attached and ready to be worn.

Turning to FIG. 18, a front view of a harness 1100 with a pop sensor 130 attached and ready to be worn is illustrated. The pop sensor system with the pop sensor may be removably or fixedly attached to a harness. In some embodiments, the pop sensor system may be positioned in location on the body that is most desirable to the player. For example, a harness may be adjusted so that the pop sensor is located on the player's chest rather than the abdomen. In other embodiments, the pop sensor system and pop sensor may be attached to other various accessories such as wraps, belts, necklaces, chains, and vests. In other embodiments, the pop sensor system may have an adhesive backing that can be placed directly on a player's skin or clothing. A pop sensor and pop sensor system may be placed on an arm, leg, back or other body part to vary the difficulty of the game.

Figure 19:
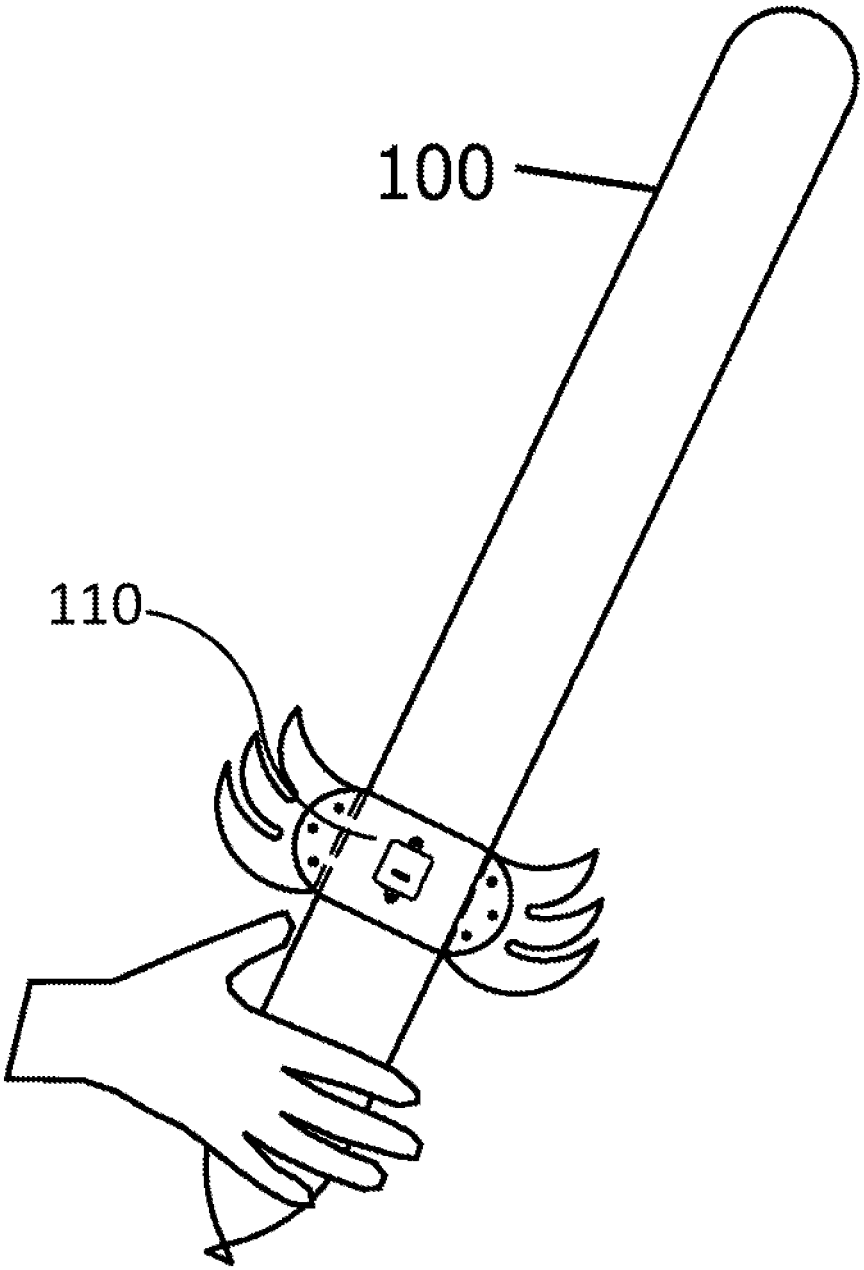
FIG. 19 shows a perspective view of a bladder 100 inserted into a pop mechanism support structure 110 and grasped by a player.

Turning to FIG. 19, a perspective view of a bladder 100 threaded through a pop mechanism support structure 110 and grasped by a player is illustrated. In preferred embodiments, the pop mechanism support structure is fit snugly against the surface of the balloon. The pop mechanism support structure may be placed at the bottom third of the length of the balloon. A player may hold the balloon directly and below the pop mechanism support structure or may hold the pop mechanism support structure itself. In some embodiments, a pop mechanism support structure may have a sheath attached that covers the bottom third of the balloon, providing the player holding the balloon extra grip and reduction of injury from the popping of the balloon. The sheath may be open-ended and may be either fixedly or removably attached to the pop mechanism support structure or may be a separate apparatus that may be included in a kit.

In some embodiments, the device for revealing a winner may be provided pre-fabricated with an inflated bladder already attached to the pop mechanism support structure. In some embodiments, the bladder may be manually or automatically inflated or filled. The bladder may be inflated or filled prior to or after threading the bladder through the pop mechanism support structure cavity. In some embodiments, the device for revealing a winner may be a single-use device and may have a permanently attached bladder or may be a re-usable device with a removably attached bladder.

Some embodiments of a pop mechanism support structure may comprise attachments such as meshes for destroyed bladder retention when the game is over or may comprise extensions such as foam for improving structural rigidity or reducing the decibels for the sound of a bladder popping. Accessories may be added to the interior or exterior of a bladder to improve rigidity and strength. Multiple layers of bladders may be filled. One attachment may be a control valve to allow for the filling of a bladder after it has been threaded through the cavity and eliminating the need for an additional assembly step of sealing the end of a bladder.

Figure 20:
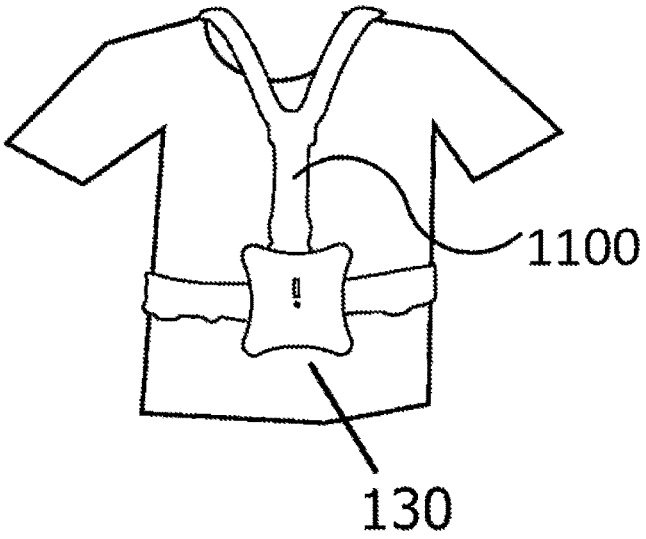
FIG. 20 shows a front view of a harness 1100 attached to a pop sensor system 130 as worn on by a player.
Figure 21:
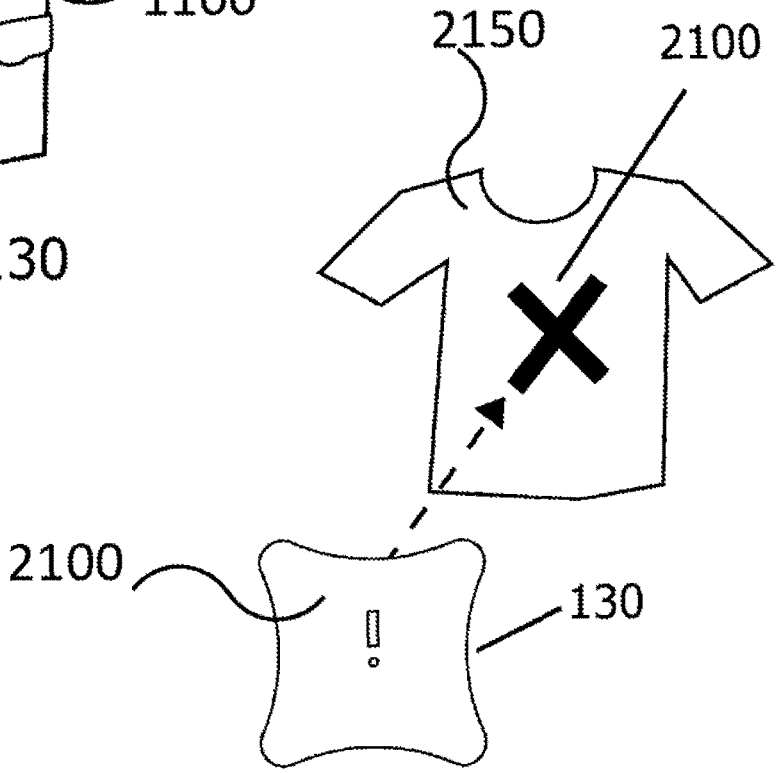
FIG. 21 shows a front view of a pop sensor system 130 being attached to clothing 2150 by complementary auxiliary fasteners 2100.
Figure 22:
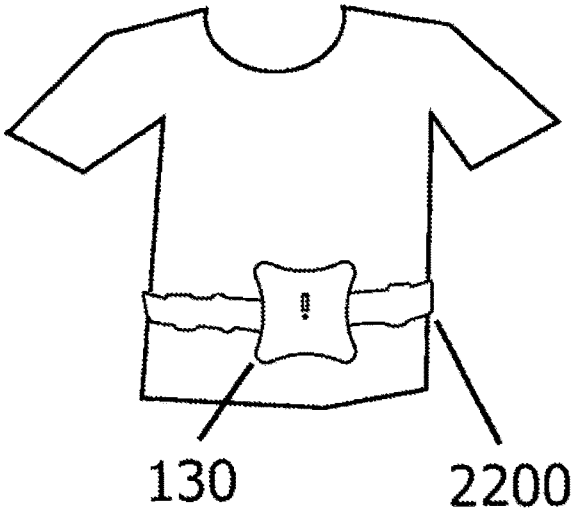
FIG. 22 shows a front view of a pop sensor system 130 attached to a belt 2200.
Figure 23:
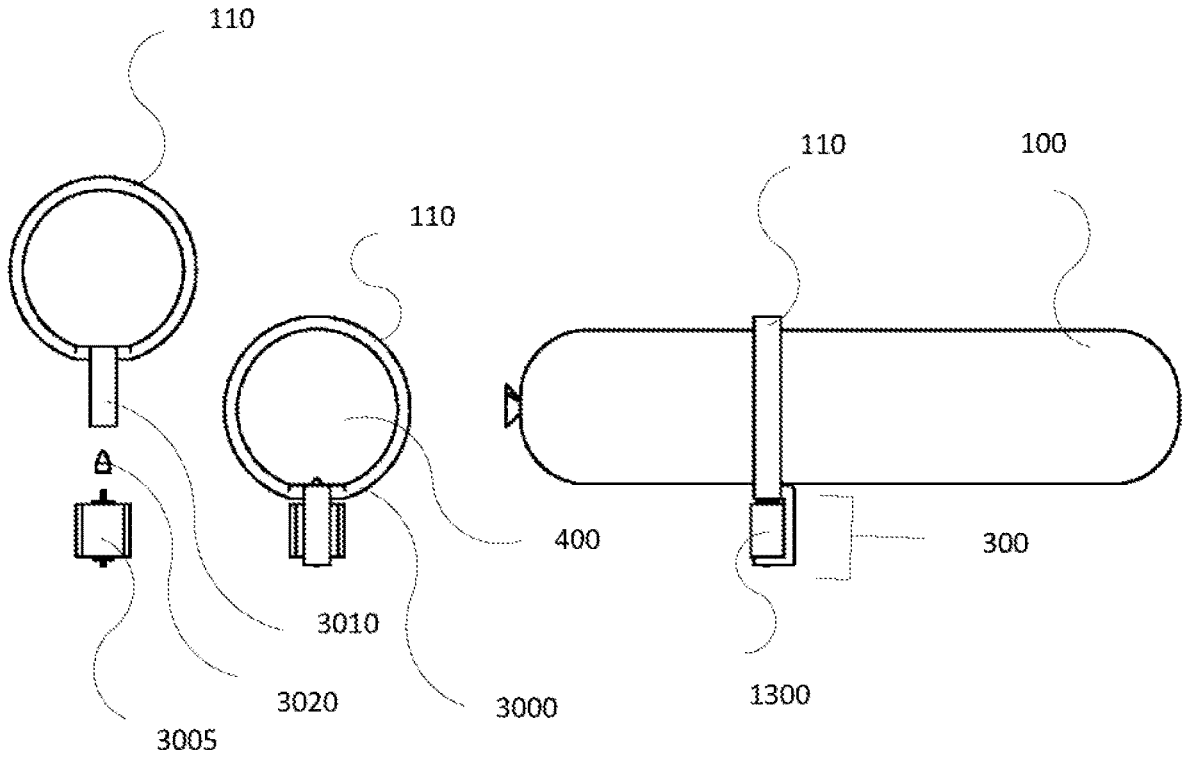
FIG. 23 shows an exemplary device with pop mechanism support structure in a ring configuration.

Turning to FIGS. 20-22, various views of a pop sensor system worn by a player is illustrated. FIG. 20 shows a front view of a harness 1100 attached to a pop sensor system 130 as worn on by a person. FIG. 21 shows a front view of a pop sensor system 130 being attached to clothing 2150 by complementary auxiliary fasteners 2100. FIG. 22 shows a front view of a pop sensor system 130 attached to a belt 2200. Specifically, FIG. 20 shows the pop sensor system attached to a harness and positioned off from the center of the player's abdomen. FIG. 21 shows a shirt and a pop sensor system having coordinating attachment or fastener so that the pop sensor system may be placed directly on an article of clothing without the need for a belt or a harness. FIG. 22 shows the pop sensor system attached to a belt that is worn by a player.

A player attaches the pop sensor system to the player's body. A player secures a pop mechanism support system to a balloon. A player activates or turns on the pop sensor system and/or the pop mechanism support system and then adjusts the settings and connects to a wireless network if necessary. At least two players play a sword-fight type game with the goal of applying pressure with the balloon to the pop sensor system of the losing player which triggers the pop mechanism to deploy, popping the losing player's balloon. The losing player is no longer able to play fight with a balloon toy sword.

In addition, multiple pop sensor support structures may be attached together on their respective outer surfaces to create a compound device for revealing a winner having multiple bladders. Also, sword fight games may be enhanced by coupling the device for revealing a winner with augmented reality or virtual reality gear. Communication between a pop sensor system and a pop mechanism may be two-way or single-way communication. The device for revealing a winner and pop sensor may be in communication with a mobile device and a corresponding application for tracking and recording game statistics and other parameters.

The following FIGS. 23 through 30 contain the following numerals of the drawings:

110. Pop mechanism support structure
300. Pop mechanism
1300. Bladder destruction apparatus
400. Cavity
100. Bladder
3000. Outer surface
3005. Depth setter
3035. Mechanical gear movement
3040. First gear
3045. Second gear
3050. Axle
3055. Revolving configuration
3060. Motor
3031. Pop mechanism support structure opening
3010. Bracket
3032. Top aperture
3033. Bottom aperture
3030. Bladder destruction mount
3085. Mount receiver
3020. Bladder destruction tip
4015. Stylized tip configuration
3090. Blunt tip
3095. Cone tip
4000. Plateau tip
4005 Tube tip
4010 Tapered tip
3025. Inner surface
3065. Power source
3070. Wire
3075. Power switch
3080. Controller Turning now to FIG. 23, an exemplary device with pop mechanism support structure in a ring configuration is shown. This configuration is an alternative to the cuff configuration as shown in the previous figures. This configuration has a pop mechanism on the outer surface as opposed to the inner surface.

Figure 24:
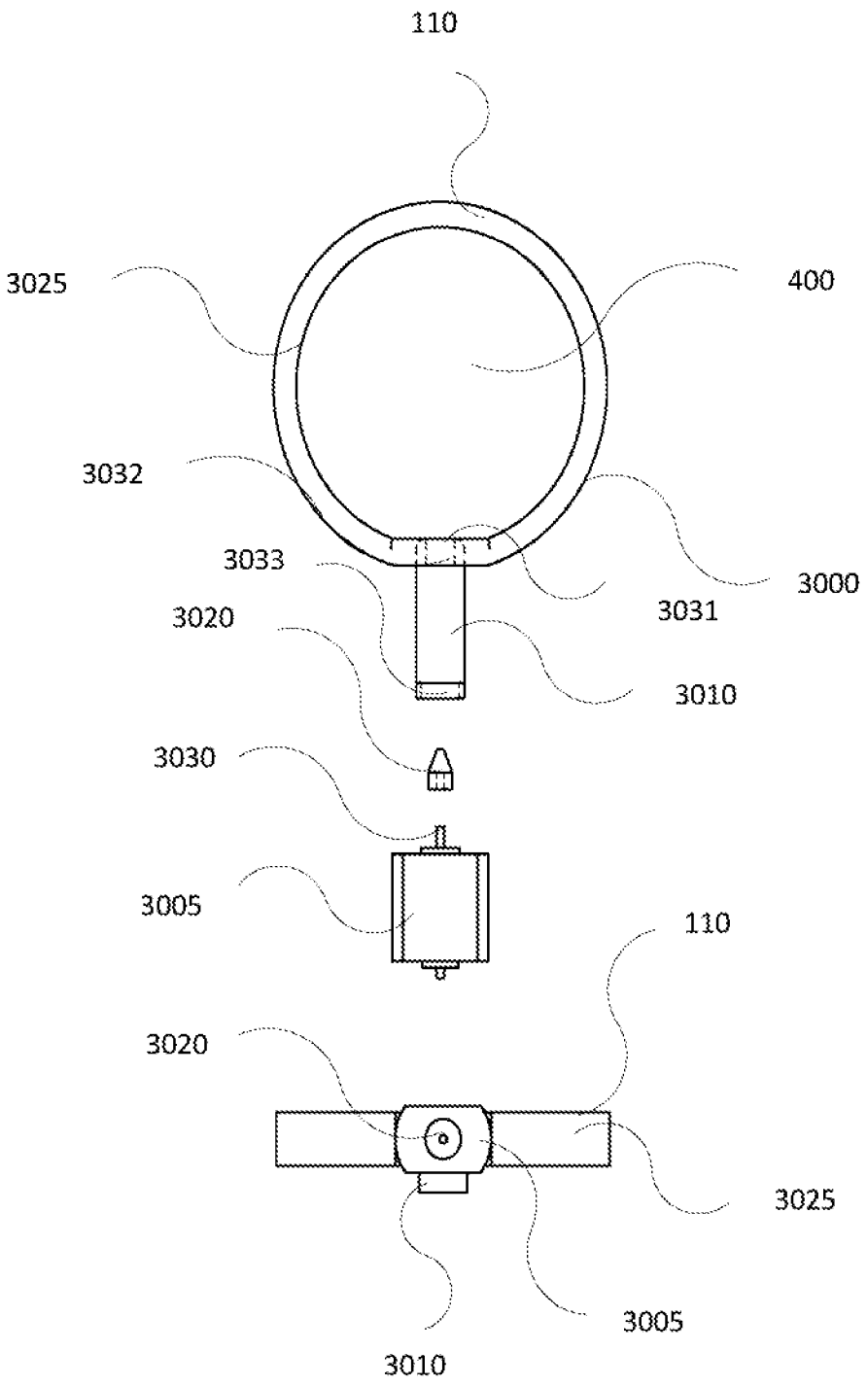
FIG. 24 shows an exploded view of an exemplary pop mechanism support structure with a pop mechanism on the outer surface of the pop mechanism support structure.

Turning now to FIG. 24, an exploded view of an exemplary pop mechanism support structure with a pop mechanism on the outer surface of the pop mechanism support structure is shown. A bracket is mounted on the outer surface. A depth setter with the bladder destruction apparatus is mounted on the bracket. The bracket contains apertures. The pop mechanism contains an aperture. The bladder destruction apparatus is threaded through the apertures to enter the cavity to come in contact with the bladder to cause destruction.

Figure 25:
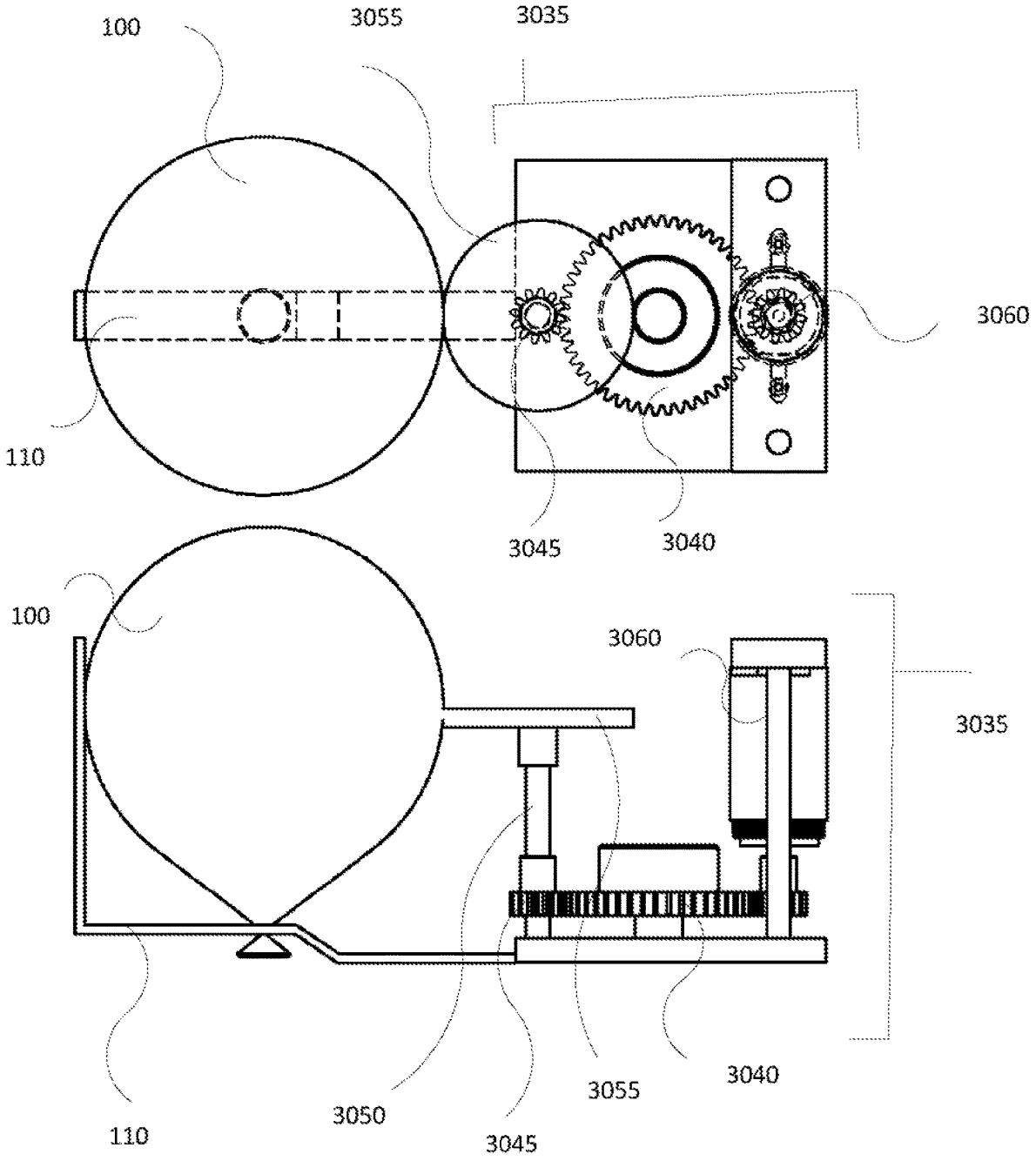
FIG. 25 shows top and side views of an exemplary mechanical gear movement with a revolving bladder destruction apparatus.
Figure 26:
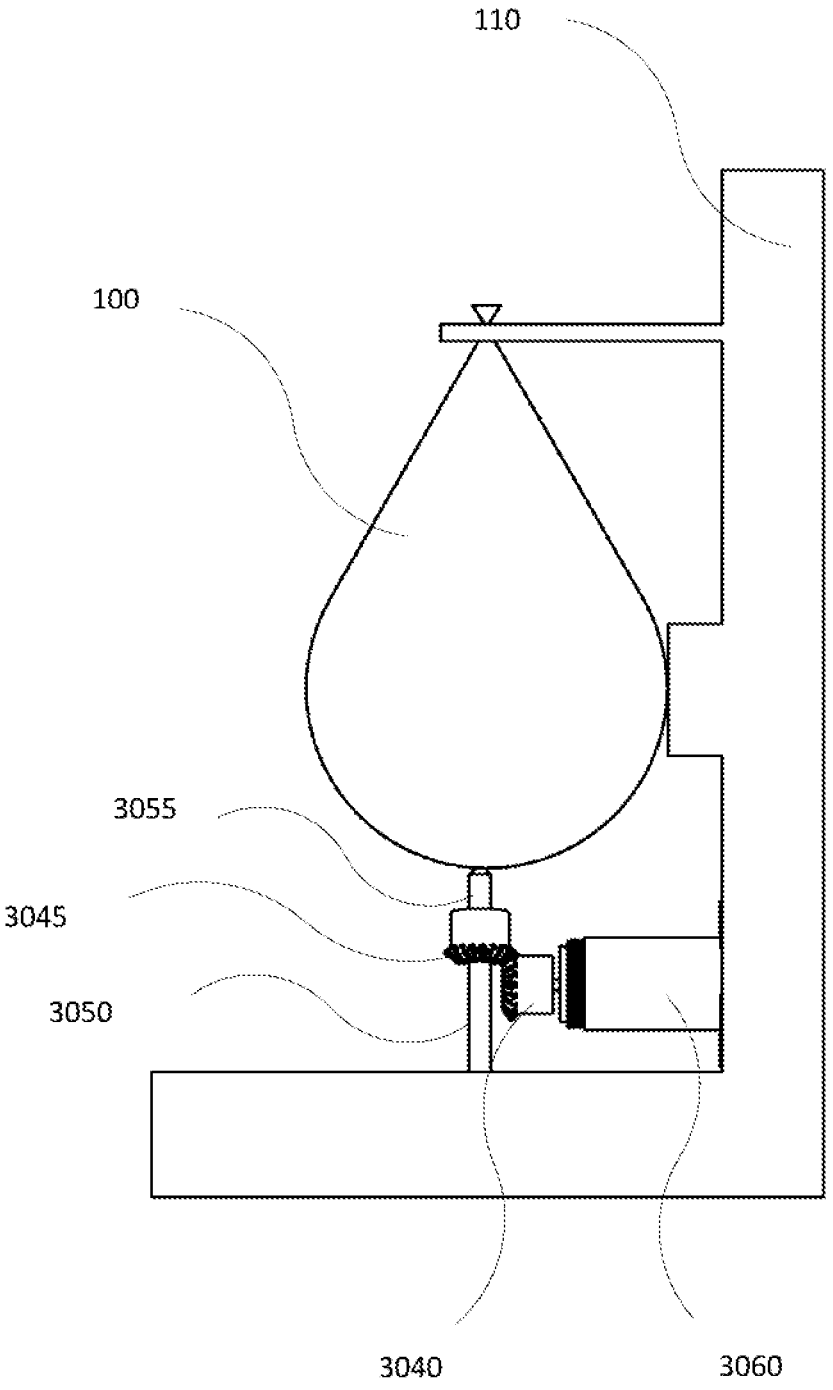
FIG. 26 shows an alternative configuration of an exemplary mechanical gear movement with a bladder destruction apparatus.

Turning now to FIGS. 25 and 26, top and side views and an alternative view of an alternative configuration of an exemplary mechanical gear movement with a revolving bladder destruction apparatus are shown. The parts are as indicated. A motor drives the mechanical gear movement to produce a revolving, turning, or spinning movement of a bladder destruction apparatus to cause a bladder to destroy from friction of the bladder destruction apparatus such as a tip coming in contact with the bladder.

Figure 27:
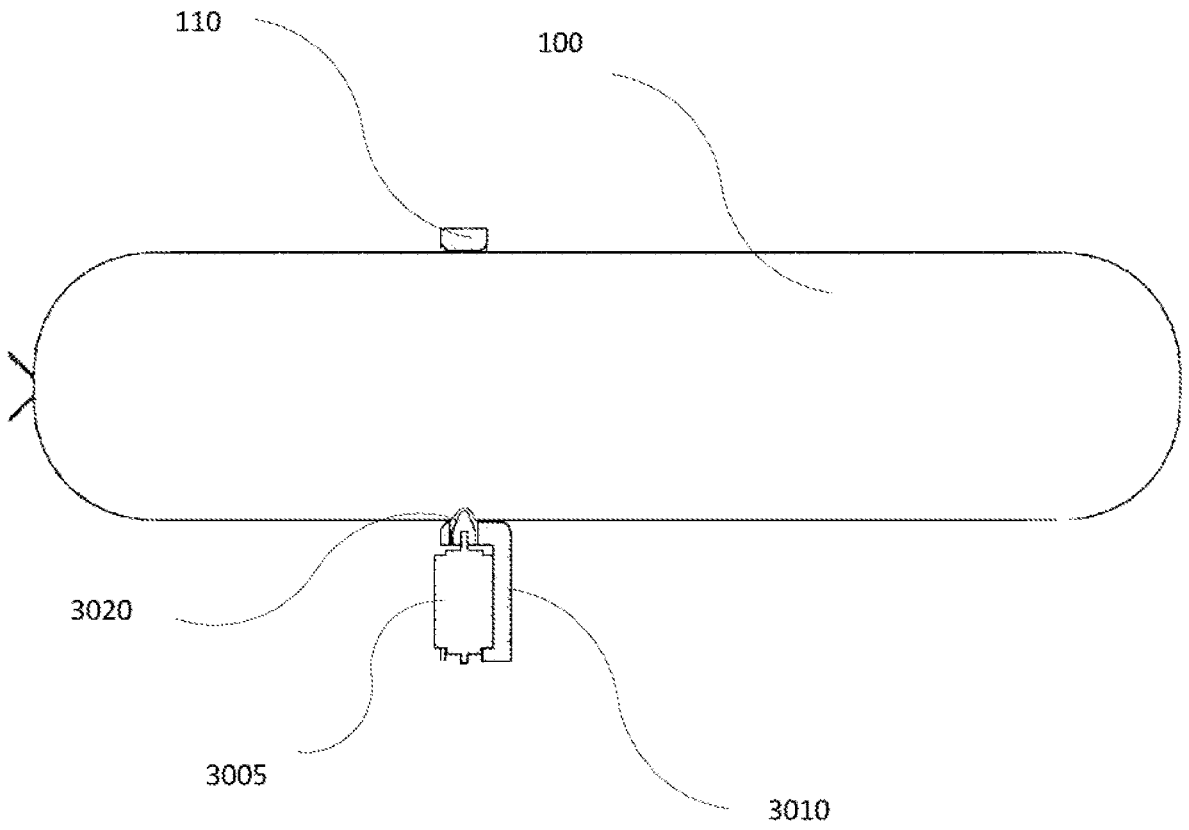
FIG. 27 shows a side view of an exemplary device.

Turning now to FIG. 27, a side view of an exemplary device is shown with the tip protruding from the outer mount and into the cavity to destroy a bladder. In some embodiments, bladder destruction occurs within 0.3 to approximately 2 second of activation of the bladder destruction apparatus.

Figure 28:
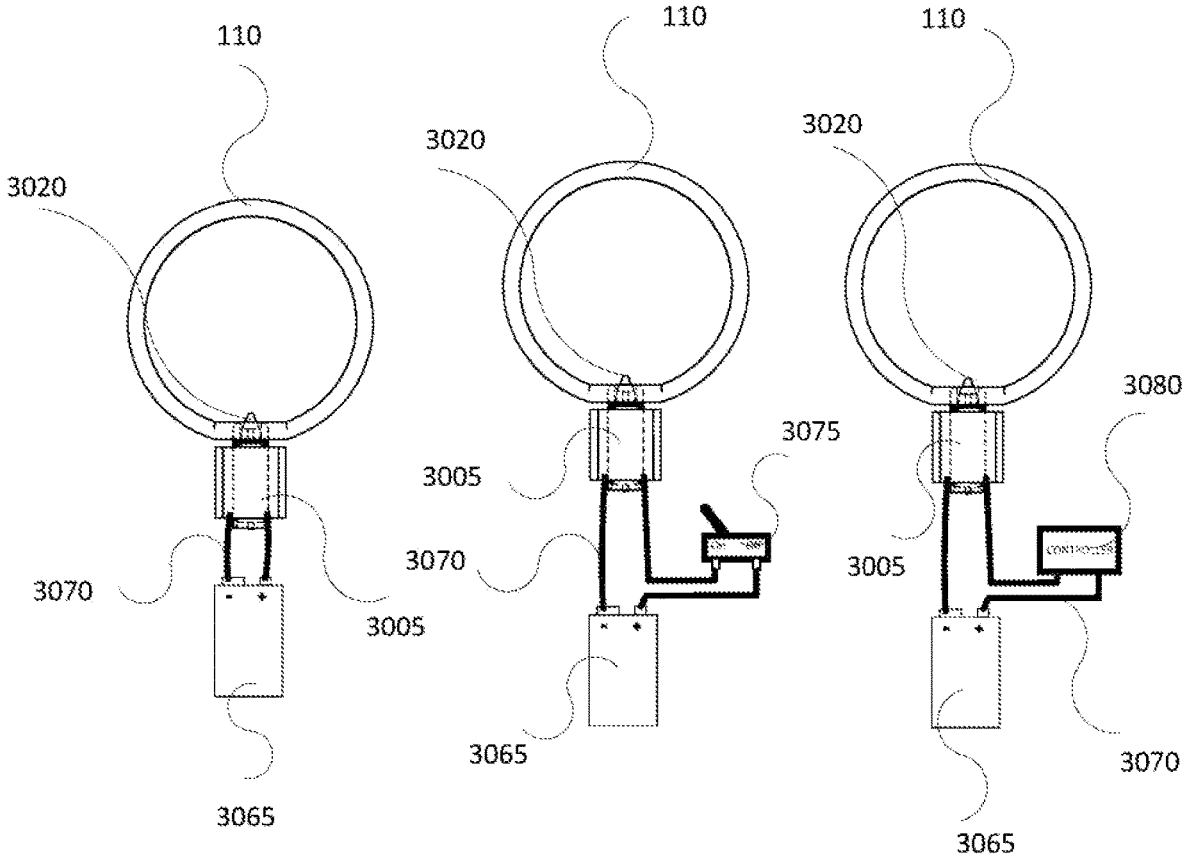
FIG. 28 shows exemplary devices coupled to a power source.

Turning now to FIG. 28, exemplary devices coupled to a power source are shown. One device is connected to a power source with wires, another further comprising a power switch, and another comprising a controller.

Figure 29:
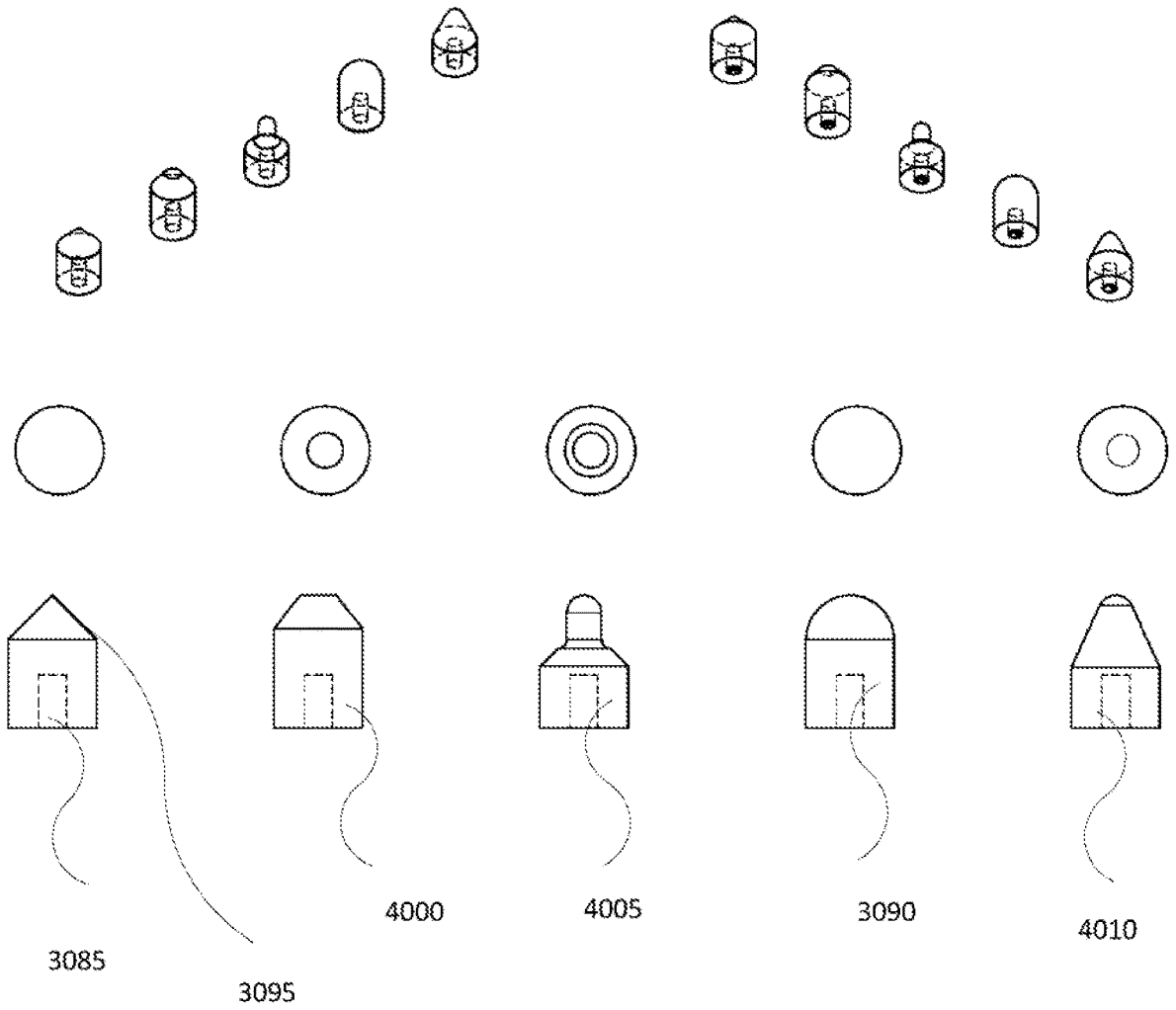
FIG. 29 shows exemplary bladder destruction tips.

Turning now to FIG. 29, exemplary bladder destruction tips are shown in their respective configurations.

Figure 30:
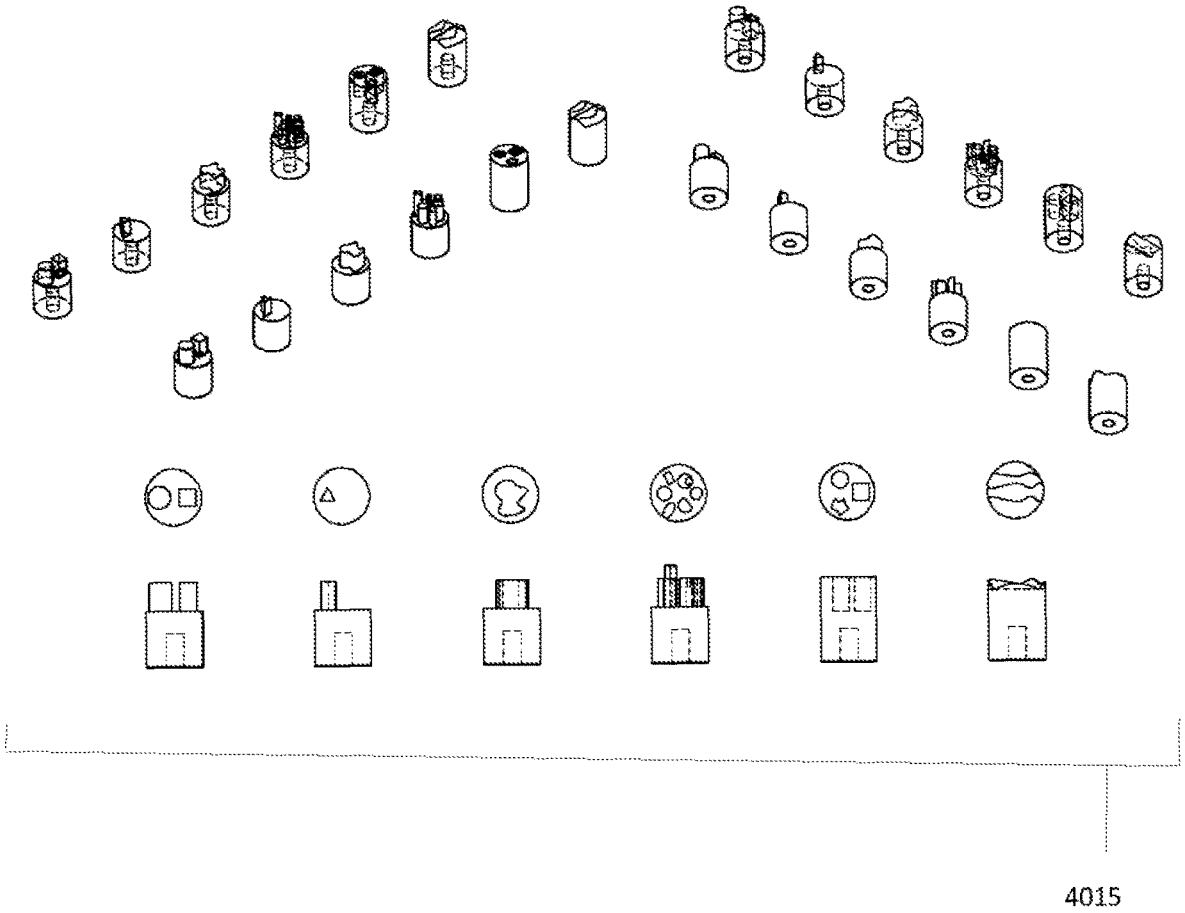
FIG. 30 shows exemplary bladder destruction tips in stylized configurations.

Turning now to FIG. 30, exemplary bladder destruction tips in stylized configurations are shown.

While the invention has been described in connection to particular embodiments, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A device for use in a sword gameplay, the device comprising:
- a pop mechanism support structure having an outer surface and an inner surface defining a cavity,
- a pop mechanism connected to the outer surface of the pop mechanism support structure,
- a bladder destruction apparatus coupled to the pop mechanism, and
- a bladder for indicating a win or a loss of the sword gameplay,
- wherein the bladder is frictionally fit within the cavity of the pop mechanism support structure at a position above a first end of the bladder but below a midpoint of a length of the bladder to form a sword for use in the sword gameplay such that activation of the pop mechanism causes the bladder destruction apparatus to destroy the bladder to designate the loss and render the bladder incapable of further use in the sword gameplay.

2. The device of claim 1 wherein the pop mechanism support structure is in a cuff configuration.

3. The device of claim 1 wherein the pop mechanism support structure is in a ring configuration.

4. The device of claim 1 wherein the bladder destruction apparatus has a tip.

5. The device of claim 4 wherein the tip has a stylized tip configuration.

6. The device of claim 4 wherein the tip has a blunt tip configuration.

7. The device of claim 4 wherein the tip has a cone tip configuration.

8. The device of claim 4 wherein the tip has a platform tip configuration.

9. The device of claim 4 wherein the tip has a tube tip configuration.

10. The device of claim 4 wherein the tip has a tapered tip configuration.

11. A method of indicating a loss in a sword gameplay using a device comprising:
- a pop mechanism support structure having an outer surface and an inner surface defining a cavity,
- a pop mechanism connected to the outer surface of the pop mechanism support structure,
- a bladder destruction apparatus coupled to the pop mechanism, and
- a bladder,
- the method steps comprising:

securing by friction fit the bladder within the cavity of the pop mechanism support structure at a position above a first end of the bladder but below a midpoint of a length of the bladder to form a sword for use in the sword gameplay, fastening a pop sensor system for use with the device to a harness, belt, vest, item of clothing, accessory, or combinations thereof, initiating the pop sensor system, initiating the pop mechanism on the pop mechanism support structure in response to the initiating of the pop sensor system to cause the bladder destruction apparatus to destroy the bladder to indicate the loss and render the bladder incapable of further use in the sword gameplay.

12. A method of revealing a winning player and disengaging a losing player in a battle game, the method steps comprising:

providing to each of two or more players a device comprising:

a pop mechanism support structure having an outer surface and an inner surface defining a cavity, a pop mechanism connected to the outer surface of the pop mechanism support structure, a bladder destruction apparatus coupled to the pop mechanism, a bladder, and a pop sensor system having a pop sensor, wherein the bladder is frictionally fit within the cavity of the pop mechanism support structure at a position above a first end of the bladder but below a midpoint of a length of the bladder to form a sword for use in the battle game, striking by a first player the pop sensor of a second player by the application of pressure to the pop sensor to activate the pop sensor to transmit data to a logic circuit, causing the logic circuit to process said data and transmit said processed data to the pop mechanism of the second player, activating the pop mechanism of the second player, activating the bladder destruction apparatus to pierce, contact, puncture, or rub, the bladder of the second player, destroying the bladder of the second player, designating the second player as a losing player and disengaging the losing player from the battle game since the destroyed bladder renders the bladder incapable of further use in the battle game, and revealing the first player having a device with the bladder still intact as the winning player.

* * * * *